United States Patent [19]

Slesarenko et al.

[11] Patent Number: 4,836,385

[45] Date of Patent: Jun. 6, 1989

[54] VIBRATORY SCREENING MACHINE

[76] Inventors: Vladimir F. Slesarenko, ulitsa Grazhdanskaya,4,kv.72; Leonid A. Vaisberg, prospekt Nauki, 24,korpus 1,kv.30; Leonid K. Balabatko, Sofiiskaya ulitsa,37,korpus 1,kv.6; Veniamin I. Sozykin, ulitsa Raziezzhaya,42,kv.2, all of, Leningrad; Amiran F. Gasseev, ulitsa Isaka,58,korpus3,kv.37, Tskhinvali, all of U.S.S.R.

[21] Appl. No.: 231,705

[22] Filed: Aug. 12, 1988

[51] Int. Cl.[4] ..... B07B 1/28

[52] U.S. Cl. ..... 209/315; 209/347; 209/365.1; 209/381

[58] Field of Search ..... 209/315, 346, 347, 322, 209/357, 365.1, 365.3, 368, 381, 382

[56] References Cited

U.S. PATENT DOCUMENTS

| | | | |
|---|---|---|---|
| 1,229,818 | 6/1917 | Sturtevant | 209/315 |
| 1,458,111 | 6/1923 | Sturtevant | 209/347 |
| 3,225,926 | 12/1965 | Dostatni | 209/315 |
| 3,796,311 | 3/1974 | Krause | 209/382 |

FOREIGN PATENT DOCUMENTS

| | | | |
|---|---|---|---|
| 345292 | 4/1960 | Switzerland | 209/315 |
| 1189508 | 11/1985 | U.S.S.R. . | |
| 1284602 | 1/1987 | U.S.S.R. | 209/315 |
| 1027137 | 4/1966 | United Kingdom | 209/346 |

OTHER PUBLICATIONS

"Vibration Technology", Vibratory Screening Machines with Pushers, Sale Brochure, no date.

*Primary Examiner*—Johnny D. Cherry
*Assistant Examiner*—Donald T. Hajec
*Attorney, Agent, or Firm*—Burgess, Ryan & Wayne

[57] ABSTRACT

Disclosed is a vibratory screening machine comprising a frame, a pair of screens mounted in the frame one beneath the other, electromagnetic vibrating drives, and two sets of pushers. Located in the frame are stops rigidly secured in relation thereto. The pushers of the first set are connected to the vibrating drives and make contact with the screen closest to the drives. The pushers of the second set are positioned within the guides in alignment with the pushers of the first set and spring-loaded against the stops in the direction of said pushers of the first set.

5 Claims, 2 Drawing Sheets

VIBRATORY SCREENING MACHINE

FIELD OF THE INVENTION

The present invention relates to devices for vibrational sizing of disperse material by screening, and more particularly to vibratory screening machines with their screening surface directly excited.

The present invention can be most successfully used in mining, metallurgical, chemical industries, in construction materials industry, and in powder technology.

BACKGROUND OF THE INVENTION

Most commonly used in present are multiple-deck screening machines wherein the separation of polydisperse materials according to size is accomplished by letting the material pass through a number of screens placed one beneath another. In this case, to provide an efficient separation of the material on each of the screens, vibrations with specific parameters should be assigned to each individual screen, and the observance of the parameters will depend on the permanent contact between the pushers transmitting these vibrations from the vibrating drives to the screens.

Known in the art is a vibratory screening machine (VEB Chemieanlagenbau Stassfurt Kombinat, DDR—"Vibration technology" Vibratory Screening Machines with Pushers) comprising a frame, a pair of screens prestressed (pretensioned) and mounted in the frame one beneath the other, electromagnetic vibrating drives, and pushers connected to the vibrating drives and extending through both of the screens. Attachment of the pushers to each screen is made by means of spring washers with elastomeric gaskets interposed between them. Thus vibrations with parameters corresponding to those of the pushers are imparted to both the screens.

One disadvantage of the above device is that such attachment of the pushers to the screens requires holes to be made in the screens, with the consequent loss of integrity of the meshes. On the one hand, it results in a reduced service life of the screen plate, and on the other hand, during operation of the machine, in the course of time, it leads to the screen sag in the inter-pusher area, due to the slackening of the pretensioned screens. It is practically impossible to avoid this screen sag. In the areas mentioned, the vibrational effect is insufficient to provide an effective screening of the material, resulting in its accumulation, whereby the overall screening effect is impaired. The provision of the required pretensioning of the screens involves a labour-consuming process of rather frequent screen replacements.

Known is a vibratory screening machine (SU, A, 1189508) comprising a frame, a pair of screens mounted within the frame one beneath the other, electromagnetic drives, and two sets of pushers, the pushers of the first set being connected with the vibrating drives and contacting the screen closest to the drives, the pushers of the second set being each disposed in the interscreen space in alignment with the pushers of the first set, inside a guide rigidly secured with respect to the frame. These guides are formed by hollow cylinders, and the pushers of the second set fitted loosely therein and contacting both the screens are sphere-shaped bodies.

During operation of the screening machine, the pushers of the second set are displaced towards the pushers of the first set by the action of elastic forces exerted by the screen farthest removed from the vibrating drives. Therefore, this screen is a means for displacing the pushers of the second set towards the pushers of the first set.

In the above device, the necessary screen elasticity, in operation, is maintained by a tensioning means. Nonuniform elasticity of the screen over its surface area will cause the steady contact between part of the pushers of the first and second sets to be lost as a result of insufficient travel speed of the second set of pushers, thereby leading to a less reliable vibration transmission from one screen to another It results in a nonuniform screening of the material over the surface of the screens, and consequently in deterioration of the overall screening effect.

SUMMARY OF THE INVENTION

It is an object of the invention to increase the effect of screening polydisperse materials.

With this and other objects in view, there is proposed a vibratory screening machine comprising a frame, an upper screen mounted in the frame, a lower screen mounted in the frame and located below the upper screen with an interscreen space formed therebetween. The screening machine further includes two sets of pushers. The pushers of the first set are in contact with one of said screens, and the pushers of the second set are located in the interscreen space, within guides, in alignment with the pushers of the first set and are in contact with both of the screens. Electromagnetic vibrating drives are provided for imparting vibrations to the pushers. Disposed in the frame are stops rigidly secured in relation thereto. The pushers of the second set are spring-loaded against said stops in the direction of the pushers of the first set.

The provision of stops in the frame, which are rigidly secured in relation thereto, and the spring-loading of the pushers of the second set against these stops in the direction of the pushers of the first set permit a steady contact to be made between the pushers of the first and second sets, since the velocity of displacement of the pushers of the second set towards the pushers of the first set is caused to increase by the action of the spring. The steady contact between the pushers of the first and second sets results in a more reliable transmission of vibration from one screen to another, thus alleviating the problem of nonuniform screening of the material over the screen surface, and consequently improving the screening effect.

In the screening machines, the electromagnetic vibrating drives may be placed either above the upper screen (the top arrangement of the vibrating drives) or beneath the lower section (the bottom arrangement of the vibrating drives). The top arrangement allows an easy maintenance, whereas the bottom arrangement reduces the overall height of the screening machine and the total amount of metal used for its construction.

In case the electromagnetic vibrating drives are located above the upper screen, i.e. when the pushers of the first set are in contact with the upper screen, the stops are preferably disposed under the lower screen and the pushers of the second set are spring-loaded against the pushers of the first set through the lower screen.

The spring-loading of the pushers of the second set through the lower screen with the electromagnetic vibrating drives located above the upper screen, causes the screen sag under gravity to be reduced, resulting in a better screening effect.

With the bottom arrangement of the electromagnetic vibrating drives, i.e. with the pushers of the first set contacting the lower screen, it is preferred that the stops be located in the interscreen space.

In this design, since the reduction of the screen sag under gravity is provided by the pushers of the first set, the interscreen arrangement of the stops is most advisable in terms of a simple construction.

With the stops arranged in the interscreen space, they are preferably realized as strips, so that the guides are formed by holes in said strips.

The stops so designed are most simple in design and adaptable to manufacture.

The pushers are preferably formed by rods with rubber-coated tips.

Such construction of the pushers provides a reduced wear-out of the screens and a longer service life.

The aforementioned objects and advantages of the proposed invention will be more apparent from the following detailed description of its embodiment with reference to the accompanying drawings.

DESCRIPTION OF THE PREFERRED EMBODIMENT OF THE INVENTION

Figure 1:
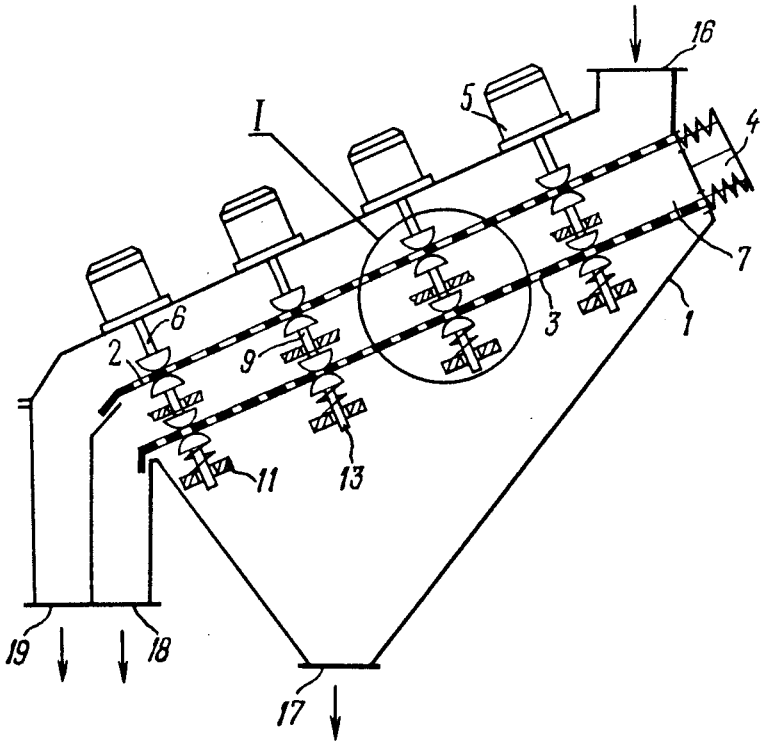
FIG. 1 is a schematic representation of a double-deck vibratory screening machine, according to the invention, with the vibrating drives located above the upper screen.

The vibratory screening machine comprises a frame 1 (FIG. 1) with an upper screen 2 and a lower screen 3 arranged therein at a slant, one beneath the other. The mesh size of the upper screen 2 exceeds that of the lower screen 3. The required elasticity of the screens 2 and 3 is maintained by providing a tensioning means 4. Located on the frame 1 above the upper screen 2 are electromagnetic vibrating drives 5, and connected thereto are pushers 6 of the first set contacting the upper screen 2 nearest to the vibrating drives 5.

Figure 2:
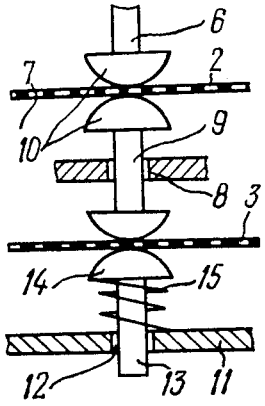
FIG. 2 is the assembly 1 of FIG. 1, an enlarged view.

In a space 7 between the screens and in alignment with the pushers 6 of the first set there are placed within guides 8 (FIG. 2) pushers 9 of the second set connecting the lower screen 3 with the pushers 6 of the first set. The pushers 6 and 9 take the form of rods. The ends of the rods are provided with rubber-coated tips 10 contacting each one of the screens 2, 3. The screens 2, 3 are protected from wear by using the rubber-coated tips 10, resulting in their longer service life.

Mounted in the frame 1 under the lower screen 3, by a suitable means such as welding, are stops 11 (the attachment means not shown in the drawing for the sake of simplicity) formed each by a strip with a hole 12. In the strip holes 12, coaxially with the pushers 9, there are disposed rods 13 with rubber-coated tips 14 contacting the lower screen 3, the rods being spring-loaded in the direction of the pushers 6 by means of springs 15 placed between the stops 11 and the rubber-coated tips 14 of the rods 13. As a result of provision of the rods 13, the screen sag under gravity is diminished, and consequently the material screening effect improved.

A loading bin 16 (FIG. 1) is fitted on the frame 1 above the top end of the screen 2. The frame 1 is provided with outlet ports 17, 18, 19 for separate unloading of below-screen, intermediate, and above-screen sizing products, respectively.

Figure 3:
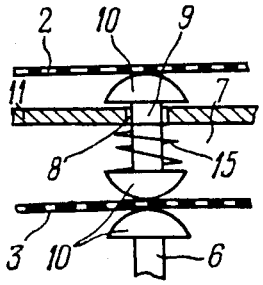
FIG. 3 is another embodiment of the assembly 1, with the vibrating drives located under the lower screen.

In one alternative embodiment of the invention, wherein the vibrating drives are disposed under the lower screen 3 (Fig.3), i.e. the pushers 6 of the first set make contact with the lower screen 3, the stops 11 are located in the interscreen space 7. Similarly to the top arrangement of the vibrating drives, the stops 11 are formed by strips. The guides 8 of the pushers 9 of the second set are formed by the holes in the strips. The springs 15 for spring-loading of the pushers 9 towards the pushers 6 are placed between the stops 11 and the rubber-coated tips 10 of the pushers 9 contacting the lower screen 3. The reduction of the screen sag occurring as a result of gravity forces is provided by the pushers 6 of the first set.

The operation of the vibratory screening machine now follows.

The vibrating drives 5 (Fig.1) transmit, through the pushers 6, vibrations to the upper screen 2, the vibrational parameters being chosen so as to give the best screening effect. The pushers 6 (Fig.2) actuate the pushers 9 and the rods 13 spring-loaded against the stop 11. As the pushers 6 and 9 and the rods 13 are moved away from the vibrating drives 5, the springs 15 are compressed. When the movement of the pushers 6 is reversed, the rods 13, and hence the pushers 9 making contact therewith through the screen 3, are also displaced by the action of elastic forces of the springs 15 towards the vibrating drives 5. The springs 15 are so designed, that their rigidity provides, during operation of the vibratory screening machine, a steady contact of the pushers 6 with the pushers 9, as the latter are displaced towards the vibrating drives 5. The steady contact between the pushers 6 and the pushers 9 results in a more reliable transmission of vibration with specified parameters to the screen 3, and consequently in an improved material screening effect.

If the vibrating drives are placed under the lower screen 3 (Fig.3) the springs 15 acting directly on the pushers 9 also provide their steady contact with the pushers 6.

The source material fed to the vibratory screening machine through the loading bin 16 is supplied to the screen 2 and changed into fluidization state. The moving particles with their size smaller than that of the meshes of the screen 2 pass through the meshes of the screen 2 and fall on the surface of the screen 3, also in a fluidized state. The particles of the size smaller than the meshes of the screen 3 enter the below-screen space and are removed from the screening machine, through the outlet port 17, as a fine-grained product. The material on the screens 2 and 3 is shifted along the screens owing to their tilted position.

The material particles of a medium size are removed from the lower screen 3 through the outlet port 18 designed for intermediate product, and the largest particles that have not passed through the upper screen 2 are removed from the above-screen space through the outlet port 19.

What is claimed is:

1. A vibratory screening machine comprising:

a frame, an upper screen mounted in said frame, a lower screen mounted in said frame and placed below said upper screen so that an interscreen space is formed between said screens, pushers of a first set, contacting one of said screens, electromagnetic vibrating drives for imparting vibrations to said pushers, pushers of a second set disposed in said interscreen space in alignment with said pushers of the first set and making contact with both the screens, guides for displacement of said pushers of the second set, disposed in said interscreen space and rigidly secured in relation to said frame, stops rigidly secured in said frame, said pushers of the second set being spring-loaded against said stops in the direction of said pushers of the first set.

2. A vibratory screening machine of claim 1 comprising said pushers of the first set making contact with said upper screen, wherein said stops are located under said lower screen, and each said pusher of the second set is spring-loaded towards said pusher of the first set through said lower screen.

3. A vibratory screening machine of claim 1 comprising said pushers of the first set making contact with said lower screen, wherein said stops are located in said interscreen space.

4. A vibratory screening machine of claim 3 wherein each of said stops is formed as a strip , and said guides are formed by holes in said strips.

5. A vibratory screening machine of claim 1 wherein said pushers take the form of rods with rubber-coated tips.

* * * * *